US005438926A

United States Patent [19]

Hudyma et al.

[11] Patent Number: 5,438,926

[45] Date of Patent: Aug. 8, 1995

[54] DEVICE FOR MAINTAINING CUT OFF REGISTRATION IN A PRINTING PRESS

[76] Inventors: Edward Hudyma, 631 Derbyshire La., Bolingbrook, Ill. 60440; JiaShen P. Lin, 1402 Buena Vista, Wheaton, Ill. 60187

[21] Appl. No.: 787,491

[22] Filed: Nov. 4, 1991

[51] Int. Cl.[6] ..... B41F 5/04

[52] U.S. Cl. ..... 101/227; 101/228

[58] Field of Search ..... 101/181, 182, 228, 219, 101/224–227; 226/2, 24, 25, 28–32, 34, 38, 39, 45

[56] References Cited

U.S. PATENT DOCUMENTS

| | | | |
|---|---|---|---|
| 3,525,858 | 8/1970 | Thiede et al. | 101/181 X |
| 3,744,693 | 7/1973 | Greiner | 226/97 |
| 4,129,238 | 12/1978 | Herd | 101/228 |
| 4,722,275 | 2/1988 | Taguchi et al. | 101/228 |
| 5,052,296 | 10/1991 | Shiba | 101/228 |

*Primary Examiner*—J. Reed Fisher

[57] ABSTRACT

A device (10) for maintaining registration in a printing press (12) having a printing unit (11) for printing a paper web (16), a device (20) for folding the paper web (16), a device (22) for cutting the folded web (16), and a device for adjusting the mass flow of the web towards the folding device (20) in order to maintain proper registration of the web (16) relative to the cutting device (22).

19 Claims, 5 Drawing Sheets

DEVICE FOR MAINTAINING CUT OFF REGISTRATION IN A PRINTING PRESS

BACKGROUND OF THE INVENTION

The present invention relates to devices for maintaining registration in a printing press.

In the past, printing presses have been known of the type having a device for printing a paper web, a device for folding the web, and a device for cutting the folded web. Although such presses have operate satisfactorily during the time that the press is under constant speed, when the speed of the press is changed, either by acceleration or deceleration of the press, the web is prone to slip in the folding device, resulting in misregistration of the web relative to the cutting device. As a result, the folded web is improperly cut at off-register locations. The inertia of idler rollers in the press and the inertia of the web mass are believed to also contribute to the misregistration during press speed changes. Hence, the web may be cut at the wrong locations during press speed changes resulting in a faulty product produced by the press.

SUMMARY OF THE INVENTION

A principal feature of the present invention is the provision of an improved device for maintaining registration in a printing press.

The device of the present invention comprises, means for printing a paper web, means for folding the paper web downstream from the printing means relative to the direction of movement of the web, and means for cutting the web associated with the folding means.

A feature of the present invention is the provision of means for modifying the mass flow of the web passing to the folding means.

Another feature of the present invention is that the mass flow of the web is modified responsive to acceleration and deceleration of the press.

Yet another feature of the present invention is that the mass flow of the web is maintained at an appropriate rate of change in the folding means during press speed changes.

Still another feature of the invention is that the rate of change in mass flow in the folding means maintains registration of the web relative to the cutting means during press speed changes.

Thus, a feature of the present invention is that the maintained registration results in cutting of the web at the desired locations by the cutting means during press speed changes as well as steady speeds.

Another feature of the invention is that the mass flow of the web passing to the printing means is maintained approximately equal to the mass flow of the web from the printing means in order to maintain registration of the press during press speed changes.

Still another feature of the invention is that the tension of the web passing to the printing means may be modified in order to obtain proper control of the web mass flow from the printing means to the folding means, particularly during press speed changes.

Yet another feature of the invention is that a force applied to the web intermediate the printing means and folding means may be modified in order to control the mass flow of the web to the folding means from the printing means, particularly during press speed changes.

A further feature of the invention is that the length of the web lead in the printing means may be modified in order to control the mass flow of the web to the folding means during press speed changes.

Another feature of the invention is that idler rollers in the press may be replaced by air bars having air passing through the bars to the web in order to eliminate then inertia due to the idler rollers and thus improve control of the mass flow of the web to the folding means during press speed changes.

A feature of the invention is that idler rollers may be replaced by driven rollers in the press in order to eliminate the inertia of the idler rollers during press speed changes.

A further feature of the invention is the provision of a system for automatically controlling the mass flow of the web passed to the folding and cutting means during press speed changes.

Further features will become more fully apparent in the following description of the embodiments of the present invention, and from the appended claims.

DESCRIPTION OF THE PREFERRED EMBODIMENTS

Figure 1:
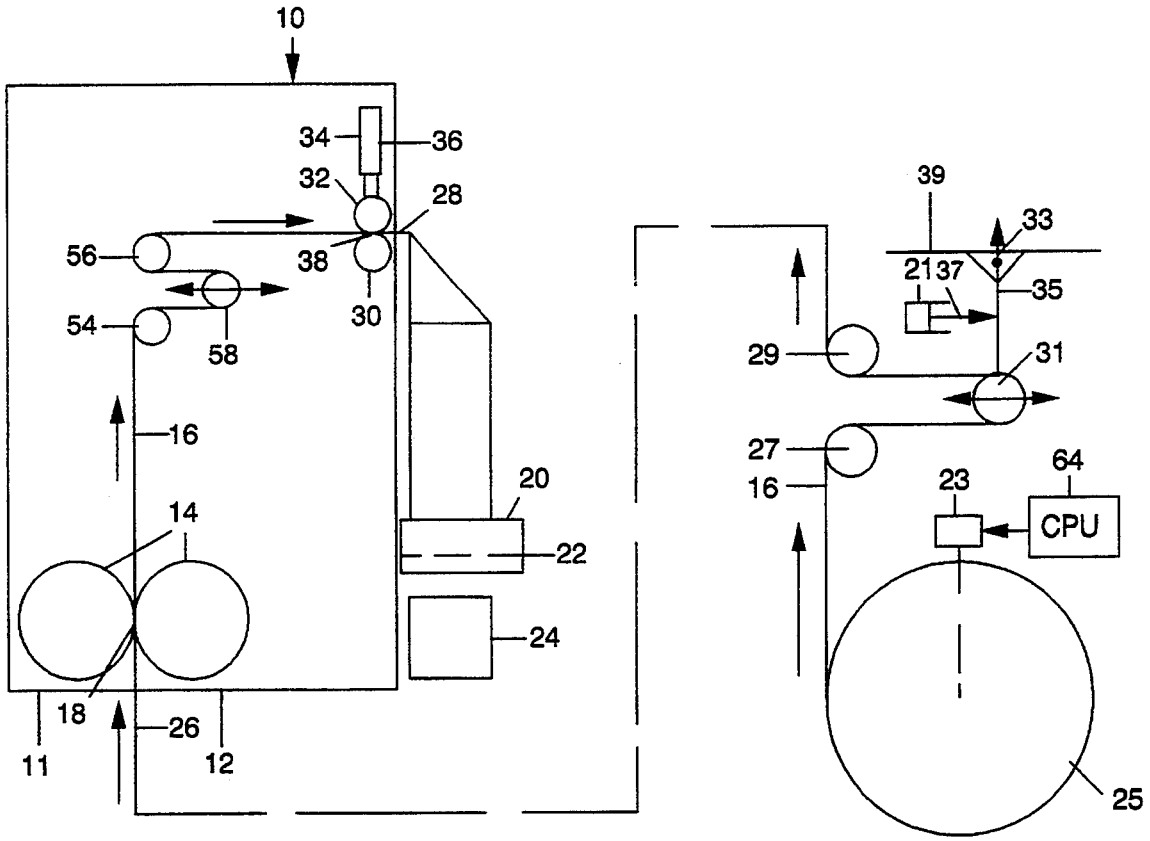
FIG. 1 is a diagrammatic view of a device for maintaining registration in a printing press of the present invention.

Referring now to FIG. 1, there is shown a device generally designated 10 for maintaining registration in a printing press 12. As shown, the press 12 has a pair of driven rollers 14 in a printing unit 11, such as blanket rollers, for printing a paper web 16 which passes through a nip 18 of the rollers 14, with the rollers 14 driving the web 16 through the printing unit 11 during printing.

The press 12 also has a device 20 for folding the web 16 passing from the printing unit 11, with the web 16 passing from the folding device 20 after being folded to a cutting device 22 which cuts the web 16 into segments 24 for publication. In the past, the web 16 may slip in the folding device 20 during changes of speed of the press 12, such that misregistration of the web 16 takes place relative to the cutting device 22 causing the web 16 to be cut at incorrect locations, with the inertia of both the mass of web 16 and idler rollers in the press 12 contributing to this result.

As shown, the web 16 passes from the rollers 14 through the printing unit 11 to the folder or folding device 20 and then to the cutter 22 associated with the folder 20 where the folded web 16 is cut into the segments 24. In accordance with the present invention, the mass flow of the web 16 entering the printing unit 11 at a location 26 is controlled to be approximately equal to the mass flow of the web 16 leaving the printing unit 11 at a location 28 intermediate the printing unit 11 and folder 20. In this manner, the mass flow of the web 16 during press speed changes is maintained at an appropriate rate of change in the folder 20 in order to maintain registration of the web 16 in the cutting device or cutter 22 to assure cutting of the web 16 at the proper locations.

As shown, the device 10 has a supply roll 25 of the paper web 16, and the web 16 passes from the roll 25 to a first idler roller 27. The roll 25 has a brake 23 to control rotation of the roll 25 and tension in the web 16, as controlled by a Central Processing Unit (CPU) or computer 64 connected to the brake 23, as will be discussed below. The web 16 passes around the idler roll or roller 27 to a dance roll 31, and the web 16 passes around the dance roll 31 to another idler roller 29. The web 16 then passes around the idler roll or roller 29 to the printing unit 11 at location 26.

The device 10 has a cylinder 21 having a piston 37 connected to a bar 35 which is pivotally supported from a suitable wall 39, with a pick off device or transducer 33 supplying a signal to the CPU, and being connected to the bar 35 at one end of the bar 35. The other end of the bar 35 is connected to the dance roll 31. The cylinder 21 in conjunction with the bar 35 serves as a reference for a desired amount of tension in the web 16. When it is desired to change the tension in the web 16, the CPU actuates the brake 23 to either loosen or impede the rotation of the roll 25, and thus decrease or increase the tension in the web 16 while cooperating with the cylinder 21 for this purpose. The cylinder 21 may also be controlled by the CPU, and may supply a signal to the CPU through the pick off 33 for control of the device.

In one embodiment, the mass flow of the paper web 16 is controlled at the location 26 passing to the printing unit 11. In the event of acceleration of the press 12, the tension on the web 16 is thus decreased at location 26 passing into the printing unit 11 such that the mass flow of the web 16 is increased into the printing unit 11, and then the mass flow of the web is increased at location 28 leaving the printing unit 11 and passing to the folder 20. The tension on the web 16 at location 26 is then returned to its initial condition after the press speed change has been achieved in the press 12. In the event of deceleration of the press 12, the tension on the web 16 is increased at location 26, such that the mass flow of the web 16 is decreased going into the printing unit 11, and the mass flow of the web 16 is also decreased passing from the printing unit 11 at location 28. After the decreased speed has been attained by the press 12, the tension on the web 16 at location 26 is then returned to its original condition for continuation of the press run at the new speed. In this manner, the tension on the web 16 is utilized to control the mass flow of the web 16 passing into the printing unit 11 in order to obtain the desired mass flow of the web 16 into the folder 20 thus reducing the register shift and maintaining registration on the web 16 with the cutter 22.

In another embodiment, as shown in FIG. 1, the printing unit 11 has a trolley 34 comprising a roller 30 and trolley wheel 32, with the roller 30 being driven, and with the trolley wheel 32 being movable towards and away from the roller 30 by a suitable air cylinder 36, and thus control the force of the roller 30 and trolley wheel 32 bearing on the web 16 in a nip 38 between the roller 30 and trolley wheel 32. In the event of acceleration during the press speed change, the force between the roller 30 and trolley wheel 32 is increased by the cylinder 36 of the trolley 34, and thus increase the mass flow of the web 16 out of the printing unit 11 passing to the folder 20. After the desired press speed change has been obtained, the force between the roller 30 and trolley 32 is returned to it its initial condition. In the event of deceleration during the press speed change, the force between the roller 30 and trolley wheel 32 is decreased in order to decrease the mass flow of the web 16 out of the printing unit 11 to the folder 20. After the new press speed has been achieved, the force between the roller 30 and trolley wheel 32 is returned to its initial level at the new press speed. In this manner, the trolley 34 is utilized to change the mass flow of the web 16 passing out of the printing unit 11 to the folder 20 in order to maintain the correct registration of the web 16 relative to the cutter 22.

Figure 2:
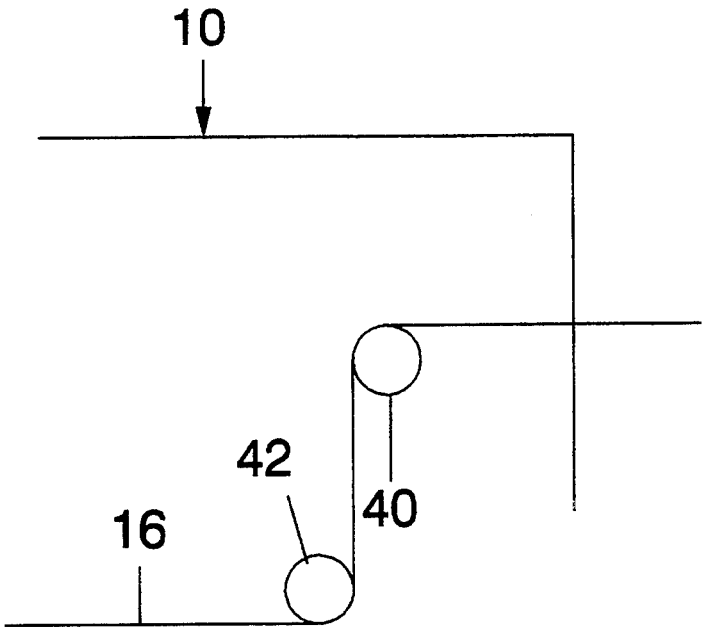
FIG. 2 is a diagrammatic view of a pair of individually driven rollers for the device of FIG. 1.

Another embodiment of the present invention is illustrated in FIG. 2, in which like reference numerals designate like parts. In this embodiment, the device 10 has a number of driven rollers 40 and 42 associated with the printing unit 11. The web 16 passes around the rollers 40 and 42 in order to drive the web 16 from the printing unit 11 to the folder 20. The driven rollers 40 and 42 replace idler rollers usually associated with the printing unit 11 in order to eliminate the inertia of such idler rollers which usually contribute to the misregistration of the web 16 and the folder 20. In other respects, the device 10 may be similar to that previously described in connection with FIG. 1.

Figure 3:
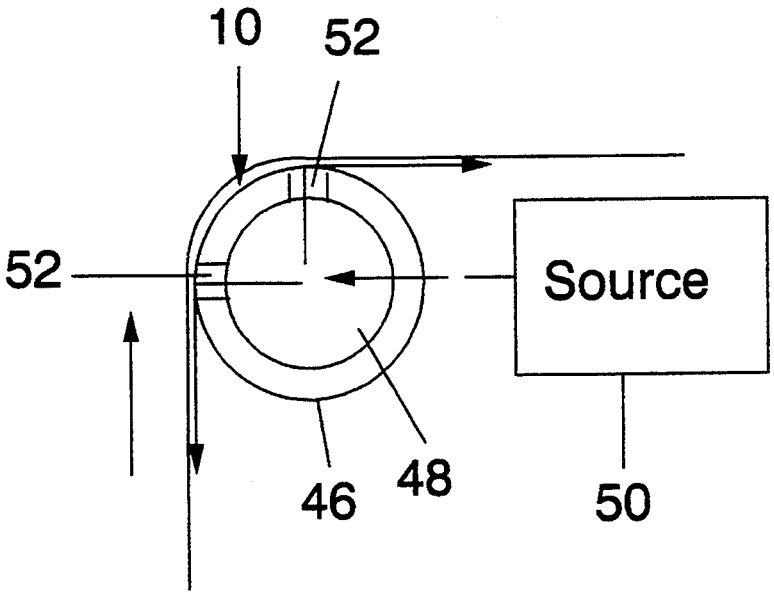
FIG. 3 is a diagrammatic view of an air bar for the device of FIG. 1.

Another embodiment of the present invention is illustrated in FIG. 3, in which like reference numerals designate like parts. In this embodiment, the device 10 has at least one fixed hollow bar 46 having a lumen 48 communication with a source 50 of air. The bar 46 has a plurality of apertures 52 communicating between the lumen 48 and the outside of the bar 46, such that the air passes from the bar 46 onto the web 16 in order to permit passage of the web 16 over the bar 46 while supporting the web 16 slightly spaced from the bar 46 and thus reduce friction between the bar 46 and web 16. Such air bars 46 replace idler rollers previously associated with the printing unit 11 in order to eliminate the inertia of the idler rollers, and maintain registration of the web 16 relative to the folder 20 and cutter 22. In other respects, the device 10 of FIG. 3 may be similar to that previously described in connection with FIG. 1.

Figure 4:
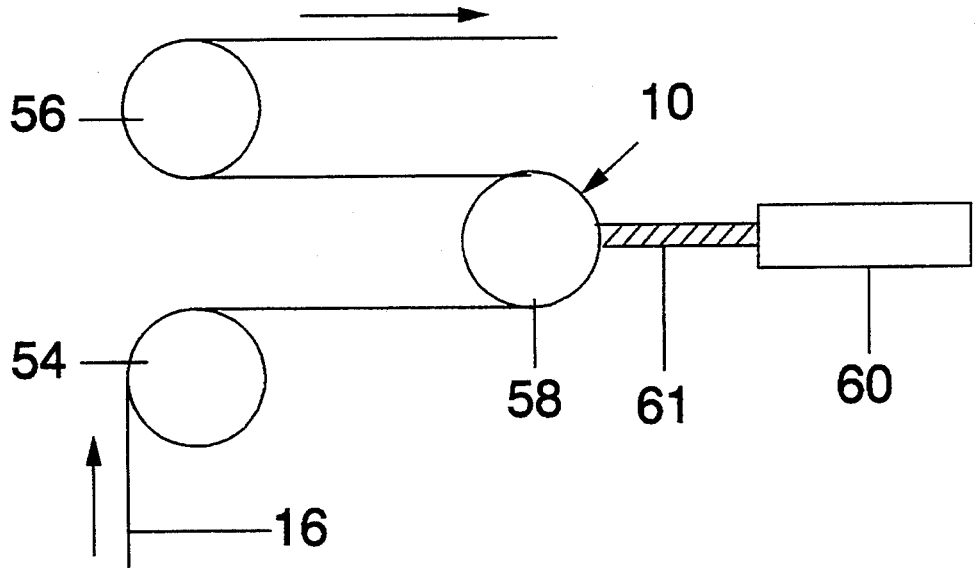
FIG. 4 is a diagrammatic view of a device for modifying the length of a paper web in the device of FIG. 1.

Another embodiment of the present invention is illustrated in FIG. 4, in which like reference numerals designate like parts. In this embodiment, the printing unit 11 has a pair of idler rollers 54 and 56 for passage of the web 16 over the rollers 54 and 56 associated with the printing unit 11. The device 10 also has a rotatable compensator roller 58 which is movable in opposed directions towards and away from the idler rollers 54 and 56 by a suitable motor 60 and associated rotatably driven threaded shaft 61, with the web 16 passing over the compensator roller 58 intermediate the idler rollers 54 and 56.

In the event of acceleration of the press 12, the compensator roller 58 is moved by the cylinder 60 towards the idler rollers 54 and 56 in order to shorten the distance of the web lead, and result in an increase of mass flow of the web 16 from the printing unit 11 towards the folder 20. After the change of speed of the press 12 has been attained, the compensator roller 58 is moved to an adjusted position with a modified web length in order to compensate for speed level of the press as well as press speed during the press run. In the event of deceleration of the press 12, The compensator roller 58 is moved in a direction away from the idler rollers 54 and 56 in order to increase the length of the web lead, and decrease the mass flow of the web 16 out of the printing unit 11 to the folder 20. Once the press has changed speeds, the compensator roller 58 is moved by the cylinder 60 an adjusted position in order to compensate for speed level of the press as well as press speed during the subsequent press run. In this manner, the mass flow of the web 16 may be adjusted by controlling the length of the web lead in order to maintain registration of the web 16 relative to the folder 20 and cutter 22. In other respects, the device of FIG. 4 may operate in a manner similar to that previously described in connection with FIG. 1.

Figure 5:
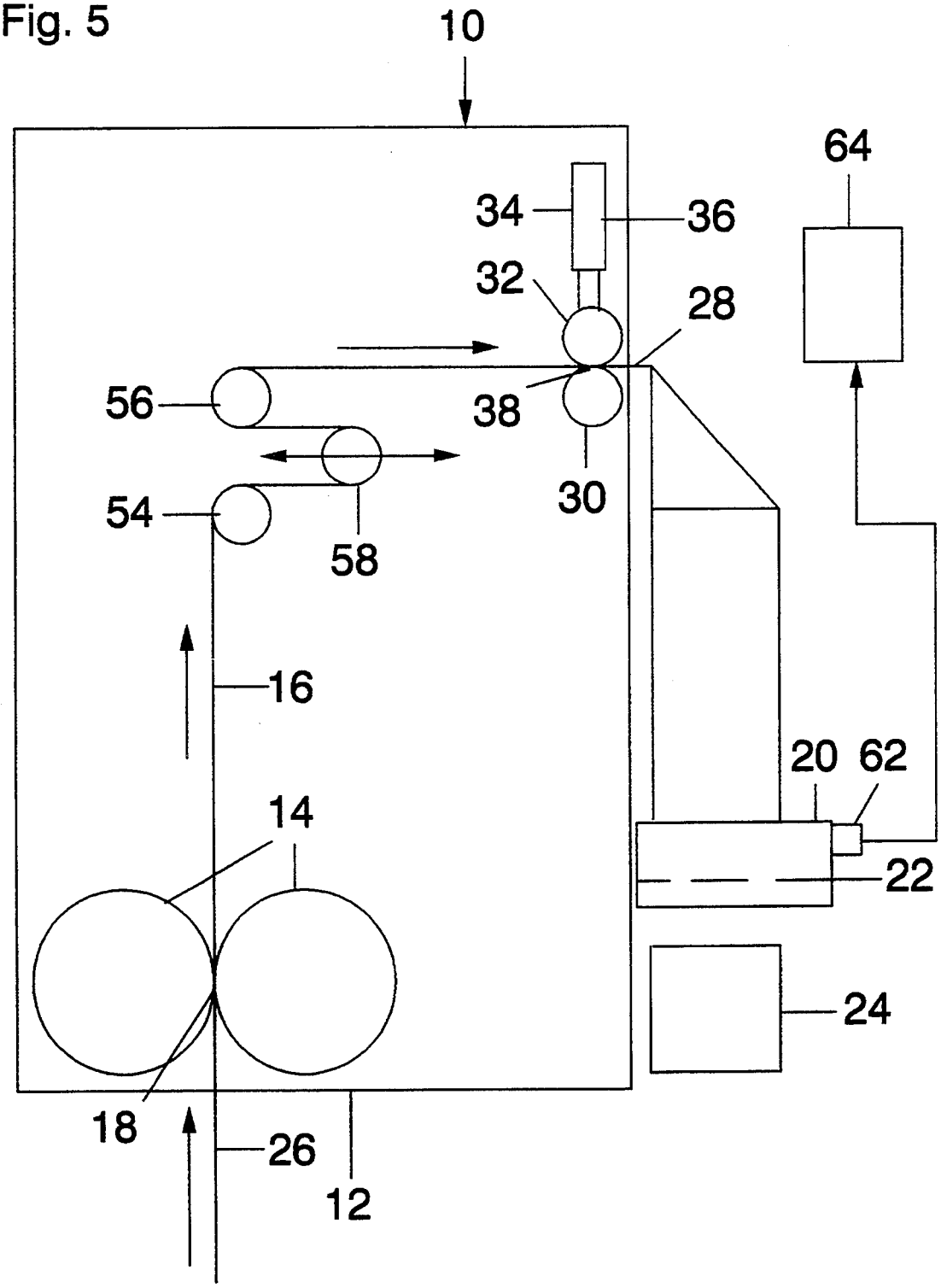
FIG. 5 is a diagrammatic view of a control system for the device of FIG. 1.
Figure 6:
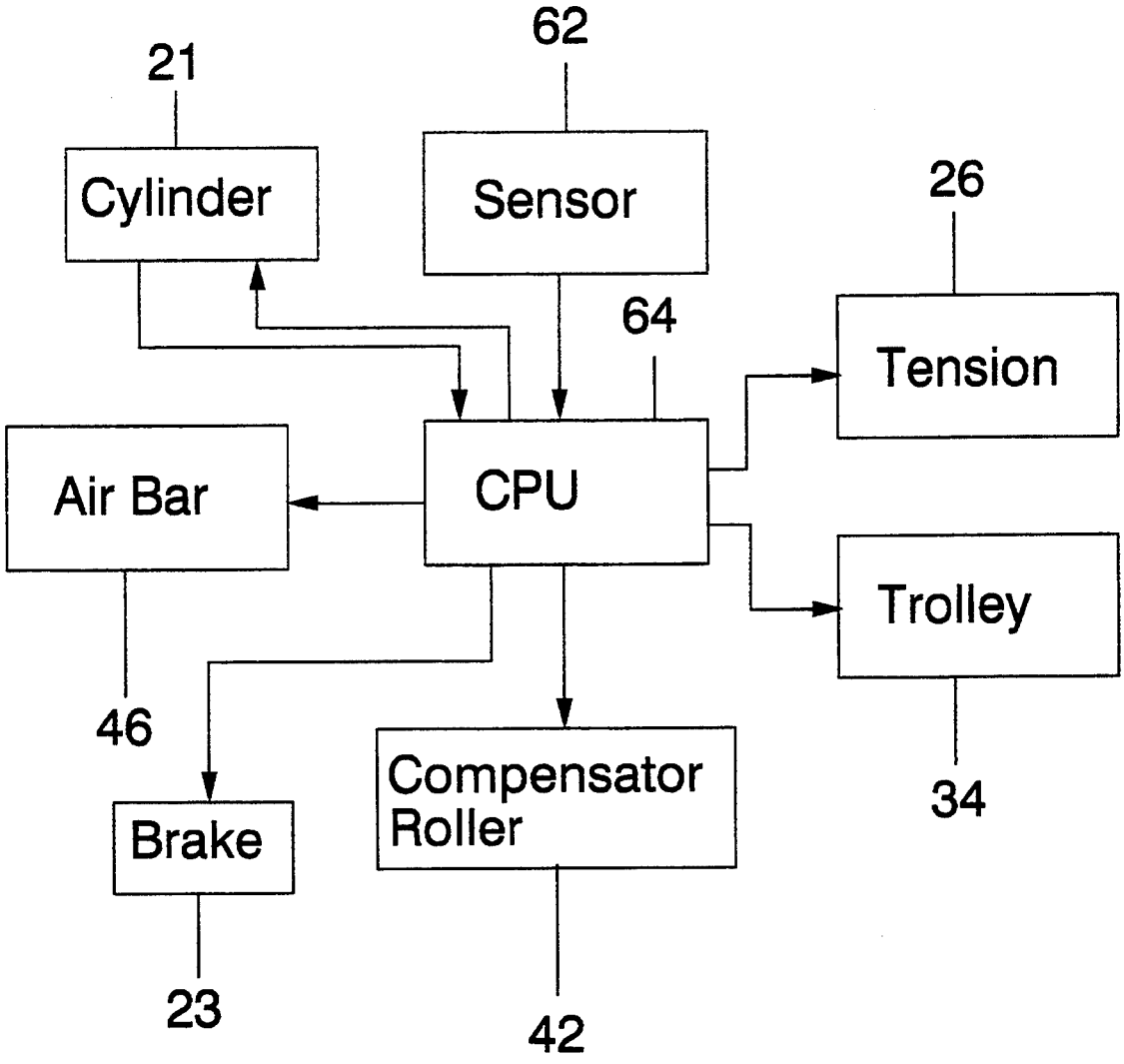
FIG. 6 is a block diagram of the control system.

Another embodiment of the present invention is illustrated in FIG. 5, in which like reference numerals designate like parts. In this embodiment, the device 10 may have a pick off device or transducer 62 at a suitable location, such on the folder 20, in order to determine the press speed, or rate of change of press speed. The device 10 has a computer 64, or Central Processing Unit (CPU) with random access memory (RAM) and read only memory (ROM), connected to the pick off device 62 in order to process information from the pick off device 62, and automatically control the device 10, such that the rate of flow of the web is changed in accordance with the pick off device 62 to place the web 16 at a desired location relative to the folder 20 and cutter 22, thus maintaining registration of the web 16. As shown in FIG. 6, the computer 64 or CPU may control the compensator roller 58, the tension at location 26, the trolley 34, or the compensator roller 42 to achieve this result. In this manner, the device has an automatic control system for obtaining the correct registration of the web 16 relative to the folder 20 and cutter 24 for proper formation of pages of the web 16 during press speed changes. Either one or more of the described devices for controlling the mass flow of the web 16 may be used together or alone, as desired.

Thus, in accordance with the present invention, the device 10 modifies the mass flow of the web 16 during press speed changes either upstream from the printing unit 11, downstream from the printing unit 11 and upstream from the folding device 20, or in the printing unit 11. The device 20 thus prevents misregistration of the web 16 relative to the folder 20 and cutting device 22 responsive to press speed changes to obtain an improve product, and minimize waste of the product by improper cutting of the web 16.

The foregoing detailed description has been given for clearness of understanding only, and no unnecessary limitations should be understood therefrom, as modifications will be obvious to those skilled in the art.

What is claimed is:

1. A device for maintaining registration in a printing press, comprising:

means for cutting a web in the press;

means for printing the web upstream from the cutting means relative to the direction of movement of the web;

means for determining the rate of change of speed of the web in the press; and means responsive to the determining means for maintaining a selected rate of change of mass flow of the web into the printing means responsive to changes of speed in the press as determined by the determining means, such that a balance between the mass flow of the web into the printing means is maintained with the mass flow of the web out of the printing means.

2. A device for maintaining registration in a printing press, comprising:

means for folding a web in the press;

means for cutting the associated with the folding means;

means for printing the web upstream from the folding means relative to the direction of web movement;

means for determining the rate of change of the speed of the web in the press; and means responsive to the determining means for maintaining desired rate of change of mass flow of the web in the folding means during changes of speed in the press such that registration of the web is maintained in the cutting means comprising, means for controlling and maintaining a balance between the mass flow of the web into the printing means and the mass flow out of the printing means.

3. The device of claim 2 including means for passing the web to the printing means.

4. The device of claim 3 wherein the maintaining means comprises means for adjusting the tension of the web in the passing means.

5. The device of claim 4 including means for increasing the tension of the passing means responsive to deceleration of the press such that the mass flow of the web is decreased to the printing means and from the printing means to the folding means.

6. The device of claim 4 including means for decreasing the tension of the passing means responsive to acceleration of the press such that the mass flow of the web is increased to the printing means and from the printing means to the folding means.

7. The device of claim 2 wherein the maintaining means comprises means for adjusting the force on the web intermediate the printing means and folding means.

8. The device of claim 7 wherein the adjusting means comprises a roller and trolley wheel passing the web in a nip between the roller and trolley wheel, and means for increasing the force of the trolley wheel on the web responsive to acceleration of the press to increase the mass flow of the web to the folding means.

9. The device of claim 8 wherein the adjusting means comprises means for decreasing the force of the trolley wheel on the web responsive to deceleration of the press to decrease the mass flow of the web the folding means.

10. The device of claim 3 wherein the maintaining means comprises at least one roller intermediate the passing means and folding means, and means for driving the at least one roller.

11. The device of claim 3 including at least one hollow air bar with the web passing around the bar, and means for passing a fluid through the bar onto the web as it passes over the bar.

12. The device of claim 11 wherein the fluid comprises air.

13. The device of claim 3 wherein the maintaining means comprises means for decreasing the length of the web lead intermediate the passing means and folding means responsive to acceleration of the press in order to increase the mass flow of the web to the folding means.

14. The device of claim 3 wherein the maintaining means comprises means for increasing the length of the web lead intermediate the passing means and folding means responsive to deceleration of the press in order to decrease the mass flow of the web to the folding means.

15. The device of claim 3 including means for modifying the length of the web lead intermediate the passing means and folding means.

16. The device of claim 15 wherein the modifying means comprises a pair of fixed idler rollers for passing the web, a compensator roller associated with the idler rollers, and means for moving the compensator roller relative to the idler rollers to change the length of the web lead.

17. The device of claim 2 including means for controlling the mass change of the web in the printing means.

18. A device for maintaining registration in a printing press, comprising:

means for printing a paper web;

means for folding the web downstream from the printing means relative to the direction of movement of the web;

means for cutting the paper web downstream from the folding means;

means for determining the rate of change of speed of the web in the press; and means responsive to the determining means for modifying the mass of web flow to the printing means, such that a balance is maintained between the mass flow out of the printing means.

19. A device for maintaining registration in a printing press, comprising:

means for printing a paper web;

means for folding the paper web downstream from the printing means relative to the direction of movement of the web;

means for cutting the web associated with the folding means;

means for determining the rate of change of speed of the web in the press; and means responsive to the determining means for modifying the mass flow of the web in the printing means, such that a balance is maintained of the mass flow of the web into the printing means and the mass flow of the web out of the printing means.

* * * * *